US006848966B2

(12) United States Patent
Wells

(10) Patent No.: US 6,848,966 B2
(45) Date of Patent: Feb. 1, 2005

(54) VISUAL STIMULATION ATTACHMENT FOR USE IN VEHICLES

(76) Inventor: Cheryl L. Wells, 9326 Northpoint Dr., Dallas, TX (US) 75238

( * ) Notice: Subject to any disclaimer, the term of this patent is extended or adjusted under 35 U.S.C. 154(b) by 0 days.

(21) Appl. No.: 10/730,446

(22) Filed: Dec. 8, 2003

(65) Prior Publication Data

US 2004/0082262 A1 Apr. 29, 2004

Related U.S. Application Data

(63) Continuation of application No. 10/023,050, filed on Dec. 15, 2001, now Pat. No. 6,682,389.
(60) Provisional application No. 60/300,688, filed on Jun. 25, 2001.

(51) Int. Cl.[7] ..... A63H 33/00
(52) U.S. Cl. ..... 446/227; 446/228; 40/593
(58) Field of Search ..... 446/227, 228, 446/229; 40/473, 591, 592, 593, 617, 643

(56) References Cited

U.S. PATENT DOCUMENTS

| | | | | |
|---|---|---|---|---|
| 4,188,745 | A | 2/1980 | Harvey et al. | |
| 4,202,130 | A | 5/1980 | Smith | |
| 4,321,768 | A | 3/1982 | Engelhardt | |
| 4,540,219 | A | 9/1985 | Klinger | |
| 4,968,279 | A | 11/1990 | Smith | |
| 5,318,555 | A | 6/1994 | Siebers | |
| D364,652 | S | 11/1995 | Santana | |
| 5,634,796 | A | 6/1997 | Dollar | |
| 6,113,454 | A | 9/2000 | Mitchell | |
| 6,183,335 | B1 | 2/2001 | Petersen | |
| 6,682,389 | B2 * | 1/2004 | Wells | 446/227 |

OTHER PUBLICATIONS

Auto Mobile TM Application Ser. No. 73/366,583, Published Dec. 28, 1982.
SAFEFIT(R) Auto Mobile(TM). Product Packaging, Date of copyright notice—2002.
http://safefit.com/2003/products/50093.htm, printed Jun. 20, 2003.

* cited by examiner

*Primary Examiner*—Derris H. Banks
*Assistant Examiner*—Ali Abdelwahed
(74) *Attorney, Agent, or Firm*—Grady K. Bergen; Robert H. Johnston, II

(57) ABSTRACT

A visual stimulation attachment for amusing an infant riding in a child safety seat or child in a vehicle that has headliner includes a visually-stimulating background member and an attachment device (e.g., a micro-hook material) secured to the background member and operable to releasably couple the background member to the headliner of the vehicle. The visual stimulation attachment may have one or more tether lines with a dangling member attached to it. A method of amusing an infant with a visually stimulating attachment and of manufacturing a visually stimulating attachment are also presented.

1 Claim, 2 Drawing Sheets

VISUAL STIMULATION ATTACHMENT FOR USE IN VEHICLES

This application is a continuation of U.S. patent application Ser. No. 10/023,050, filed Dec. 15, 2001, now U.S. Pat. No. 6,682,389, which claims the benefit of U.S. Provisional Application Ser. No. 60/300,688, filed Jun. 25, 2001.

FIELD OF THE INVENTION

The present invention relates to devices to amuse infants and children, and more particularly to a visual stimulation attachment for use in vehicles that attaches to the ceiling of the vehicle.

BACKGROUND OF THE INVENTION

Protective child safety seats for use in vehicles are now the norm in many places around the world. In the United States, many states have laws requiring the use of child safety seats. For younger infants, the child safety seat is placed in the seat of the vehicle facing backwards, i.e., opposite the usual forward movement of the vehicle. The infant is left to see primarily the back of the vehicle seat and the vehicle's ceiling. Without more, this view does not amuse most infants for very long. Various efforts have been made to provide entertainment or amusement for infants that are placed in child safety seats.

U.S. Pat. No. 4,188,745, and entitled "infant toy," describes a tube arrangement for suspending items in front of an infant in a child seat. The arms attach to the car seat by adhesive plates and thumbscrews. The toy suspends playing objects such as bells, mirrors, stars, or any other objects that are attractive to the infant from rubber springs. The tube system requires mechanical attachment to the car seat itself.

U.S. Pat. No. 4,321,768, entitled "educationally correlative amusement device," presents a device for amusing young children in a child safety seat. The device attaches directly to a bar of a child safety seat with a strap.

U.S. Pat. No. 4,540,219, entitled, "infant safety seat attachment," describes an attachment in the form of a wrap-around cover that is fitted to a child safety seat. The cover contains various items (e.g., stuffed toy, teething rings, rattles, etc.) for amusing the infant.

U.S. Pat. No. 6,113,454, entitled "amusement center for rear facing infant child seats," describes an amusement center that is supported by clips or straps that rests against the back of a car seat. The amusement center may contain photographs, pictures, stuffed dolls, etc. It appears to be a static display.

U.S. Pat. No. 6,183,335, entitled "suspended display arrangement for vehicles," describes a device that rests on the back of a car seat in front of a child safety seat. The device includes an opaque back panel, a clear front panel, and a number of display units such as decorative articles that are suspended from short tether elements between the panels. The display units are configured to swing freely back and forth between the panels, i.e., in a two-dimensional plane, in response to the vehicle moving.

SUMMARY OF THE INVENTION

Therefore, a need has arisen for a visual stimulation attachment that addresses shortcomings of other devices used to amuse infants and children in car seats in vehicles and children in vehicles in general. According to an aspect of the present invention, a visual stimulation attachment for amusing an infant riding in a child safety seat or a child in a seat in a vehicle that has an interior ceiling includes a visually-stimulating background member and an attachment device (e.g., a micro-hook material) secured to the background member and operable to releasably couple to the interior ceiling of the vehicle. According to another aspect of the present invention, the visual stimulation attachment further includes one or more tether lines having a dangling member attached to it. According to another aspect of the present invention, the dangling members and/or aspects of the background member may include glow-in-the-dark images. According to another aspect of the present invention, the visual stimulation attachment further includes a decorative attachment that is coupled to the background member.

According to another embodiment of the present invention, a visual stimulation attachment is provided that includes a decorative attachment having an attachment device coupled to it for releasably attaching the decorative attachment to the ceiling of a vehicle. According to another embodiment, the visual stimulation attachment further includes a tether line structurally coupled at one end to the decorative attachment and at the other end to a dangling member.

According to another aspect of the present invention, a method of amusing an infant riding in a child safety seat or a child in a seat in a vehicle having a ceiling is provided that includes the steps of: providing a visual stimulation attachment having a micro-hook material secured on one side; and using the micro-hook material to secure the visual stimulation attachment to the ceiling of the vehicle above the infant or child.

The present invention provides numerous advantages. A number of examples follow. An advantage of the present invention, in one embodiment, is that the attachment device can be readily placed above the infant in a child safety seat (facing rearward or forward) and it will be in the child's immediate view. Another advantage of the present invention in an embodiment with tether lines is that movement in three dimensions helps to amuse the infant or child. Another advantage of the present invention is that it can be quickly put into place and removed from a vehicle. Another advantage of an embodiment of the present invention is that it can be re-configured to present different themes or images to an infant or child. Another advantage of the present invention is that it can be quickly applied to help amuse an infant during the process of loading the child into a car seat.

BRIEF DESCRIPTION OF THE DRAWINGS

For a more complete understanding of the present invention and advantages thereof, reference is now made to the following description taken in conjunction with the accompanying drawings in which like reference numbers indicate like features, and wherein.

DETAILED DESCRIPTION OF THE INVENTION

The preferred embodiment of the present invention and its advantages are best understood by referring to FIGS. 1–4 of the drawings, like numerals being used for like and corresponding parts of the various drawings.

Figure 1:
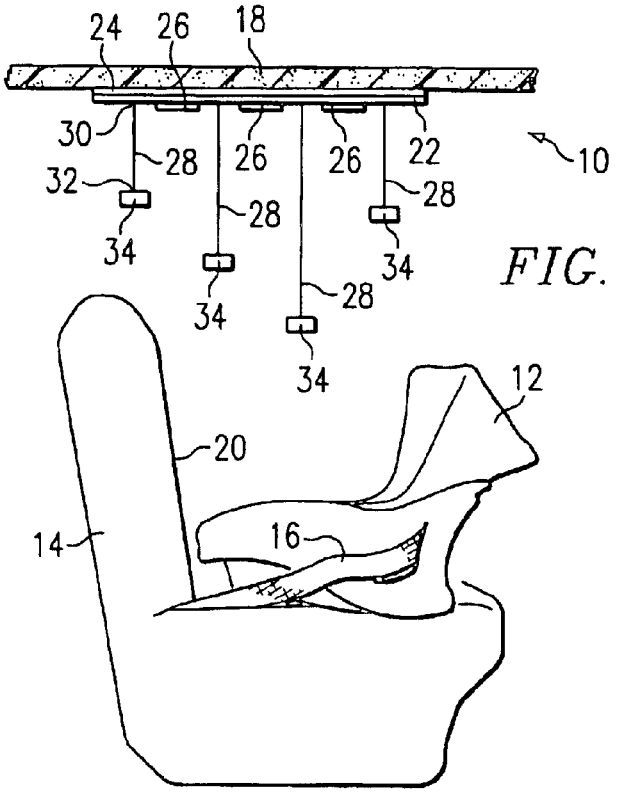
FIG. 1 is a cross-sectional schematic diagram showing a visual stimulation attachment according to one embodiment of the present invention secured to the interior ceiling of a vehicle above a car safety seat.

Referring to FIG. 1, a visual stimulation attachment 10 is shown in the context of a child safety seat 12 that is resting on a portion of a vehicle passenger seat 14. Child safety seat 12 is shown secured to seat 14 by safety belt 16. In this rear-facing position, an infant within child safety seat 12 is limited to looking at the vehicle's ceiling 18 or the front 20 of seat 14. (Note: While the preferred embodiment is envisioned for use with an infant in a child seat as shown in FIG. 1, it may also be used to amuse children who are not a in a car seat).

To entertain, educate, and amuse the infant while riding in child safety seat 12 or child when seated on seat 14, the visual stimulation attachment 10 is provided and secured to an interior portion of ceiling 18 above the infant or child. The visual stimulation attachment 10 includes a background member 22 that is releasably attached by an attachment device 24 to the interior of ceiling 18. The background member 22 is made of any relatively soft material that remains safe in the event that it falls on the infant or child or if it is involved in an accident. As a few examples, member 22 could be made of cloth, vinyl, padded foam, craft foam, plastics, paper, paper mache, cardboard, STYROFOAM® multicellular expanded synthetic resinous material, soft wood, etc.

The attachment device 24 can be any attachment means that allows for the background member 22 to be releasably secured to the interior portion of ceiling 18. The attachment device 24 is preferably a micro-hook material or friction fastener material, e.g., a micro version of a VELCRO® fastener, that when pressed against a headliner material on ceiling 18 engages it: forms a hook-and-loop connection. An example of a suitable material is the hook portion of material HTH 830 from VELCRO USA, Inc., Manchester, N.H.; it is a made with a standard polypropylene resin. Other examples from VELCRO USA, Inc. are model HTH 811 and 833, which is a high-density polyethlene (HDPE) and HTH 706, 707, and 708. The micro-version of the hook material is preferred because it readily engages the material used on most headliners. The attachment device 24 could also be strong, imbedded magnets that are attracted to the metal of the vehicle's roof or could be safety pins placed along the periphery of the background member 22.

Figure 3:
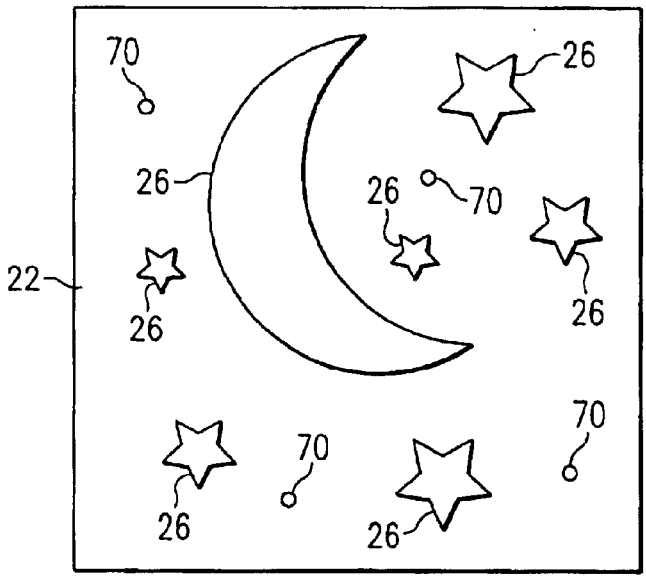
FIG. 3 a plan view of the visual stimulation attachment of FIGS. 1 and 2.

One or more decorative attachments 26 are preferably attached to the background member 22 by adhesive or other means. The visual arrangement of background member 22 and the decorative attachments 26 provides visual stimulation for the infant or child on seat 14, and they will typically form a theme or motif. For example, as shown in FIG. 3, the background material 22 may be a black material that represents a night sky and the decorative attachments 26 can be stars and a moon. Numerous possible themes exist and additional examples are given further below. Bright colors and expressive characters are preferred for the background material 22 and/or decorative attachments 26.

In an another embodiment, the decorative attachments 26 may be omitted and the entire visual stimulation provided by the background member 22, which may have a picture or figure on it. The picture can be added by transfer or ink or other means. On both the background member 22 and the decorative attachments 26, glow-in-the-dark paints or materials may be used to provide stimulation during night trips. In another alternative embodiment, the decorative attachments 26 can be used without a background member 22 by directly attaching an attachment device to the decorative attachment. With this alternative, a group of decorative attachments 26 may be placed directly on a headliner 44 to form a theme independent of any background member 22.

Figure 2:
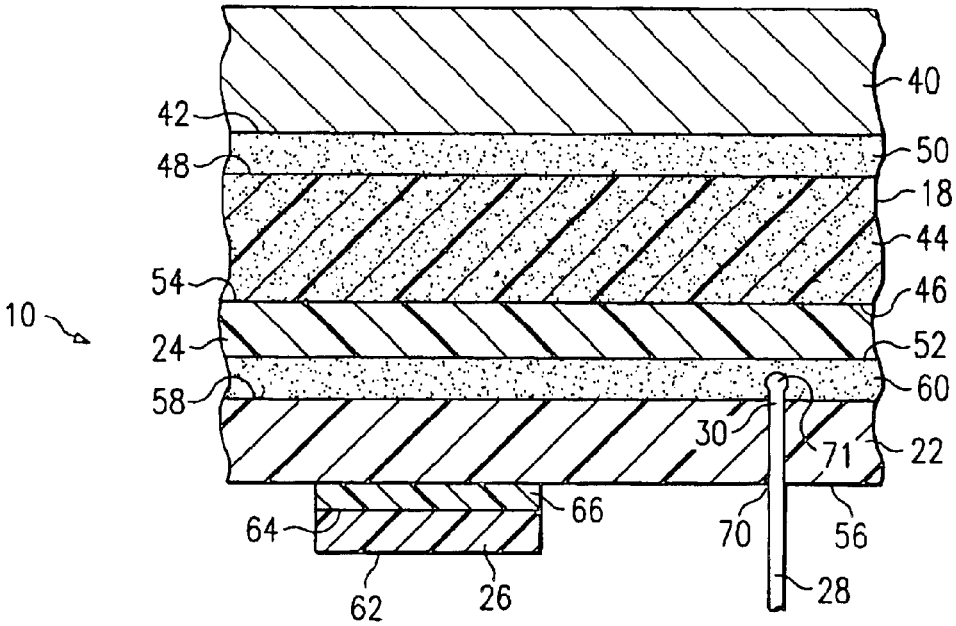
FIG. 2 is a cross-sectional diagram of a portion of the visual stimulation attachment of FIG. 1.

Continuing with the description of the embodiment of FIGS. 1–2, one or more tether lines 28, each having a first end 30 and second end 32, can be structurally coupled to the background member 22 (or the decorative attachment). "Structurally coupled" means that in one way or another the support forces are communicated to the member. The structural coupling may be accomplished with knots, adhesives, or other suitable means for securing. The tether lines 28 can be made of cloth, cord, a spring material (e.g., rubber) or other soft material. The first end 30 is structurally coupled to the background member 22. A dangling member 34 is attached to the second end 32 of tether line 28.

The dangling members 34 can be made of the same type of materials as used for the background member 22, e.g., foam, cloth, etc. or can be other items such as light-weight stuffed dolls. Dangling members 34 can be sized, shaped, and colored to help visually stimulate the infant in seat 12. Examples of the many types of dangling members 34 include stars, balls, mirrors, bells, stuffed toys, teething rings, rattles, a pocket or sleeve for photographs, small lights, or possibly a music device. In the alternative design mentioned two paragraphs above, a decorative attachment such as a baseball glove may have a tether line hanging from it that has a baseball attached to it as the dangling member. These are only illustrative examples; there are many other possibilities.

The length of tether lines 28 can be short (1 to 2 inches; 2.54 to 5.08 centimeters) merely to provide movement of dangling members 34 in response to motion of the car or can be lengthier so that they swing just out of reach of the infant located in seat 12. In other embodiments, the tether line 28 could be made long enough for the dangling member 34 to be reached by a child. The preferred length for use in most cars is about 1.5 to 3 inches (3.8 to 7.6 centimeters). The tether lines 28 may be of different lengths or may be the same length. With reference to the night sky theme, the dangling members could be stars, and in this scenario might be glow-in-the-dark stars to provide stimulation during night trips. The movement of the dangling members 34 contributes significantly to the amusement value of stimulation attachment 10. By hanging from a tether line 28, the dangling members 34 are free to move in three-dimensions in response to movement of the car.

Referring now to FIG. 2, a portion of the visual stimulation attachment 10 is shown secured to ceiling 18 of the vehicle. In this view, the ceiling 18 is shown as being made up of the exterior roof 40, which has a first side 42, and a headliner 44, which has a first side 46 and a second side 48. The second side 48 is attached to the first side 42 of roof 40 by an adhesive 50. The attachment device 24 has a first side 52 and a second side 54. The background member 22 has a first side 56 and a second side 58. The second side 58 of the background member 22 is secured by an adhesive 60 (e.g., could be a high tack, pressure sensitive strip or an epoxy or adhesive means) to the first side 52 of the attachment device 24. In this embodiment, attachment device 24 is attached directly to headliner liner 44 by miniature- or micro-hooks (not explicitly shown) that engage the material of headliner 44 (the headliner functions as the loop portion of the hook-and-loop connection) to provide a releaseable connection.

The decorative attachment 26 has a first side 62 and a second side 64. The second side 64 is attached to the first side 56 of the background material 22 by an adhesive 66. The first end 30 of the tether line 28 is attached to the first side 56 of the background member 22 by an adhesive, a micro-hook material or by going through an aperture 70 in the background material 22 and being secured on the second side 58 with a knot 71 (this is what is shown in FIG. 2), adhesive, or by other means (e.g., thermal, ultrasonic weld, staples, clips, etc.).

Referring to FIG. 3, a plan view of one possible scene on attachment 10 (shown as an infant in car seat 12 might view it) is shown with the exception that the dangling members and tether lines have been removed. The background member 22 is preferably sized to occupy the space on the ceiling 18 (see FIG. 1) above the infant or child. For example, background member 22 could be 8 inches by 10 inches (20.3 centimeters by 25.4 centimeters) or could be 16"×12" (40.6×30.4 centimeters) to name only two possibilities. An unlimited number of themes for attachment 10 are possible. Examples of themes include the following: alphabets, numbers, barnyard, cartoon character scenes, an underwater scene, Noah's ark, flowers, sports, animals, nature, tea cups, doll houses, gardens, ballerinas, angles, circuses, outer space, and seasonal and holiday designs (Christmas, Halloween, Thanksgiving, etc). etc. The background member 22 might also be a simple map of the United States, world, or other entertaining educational objects.

Figure 4:
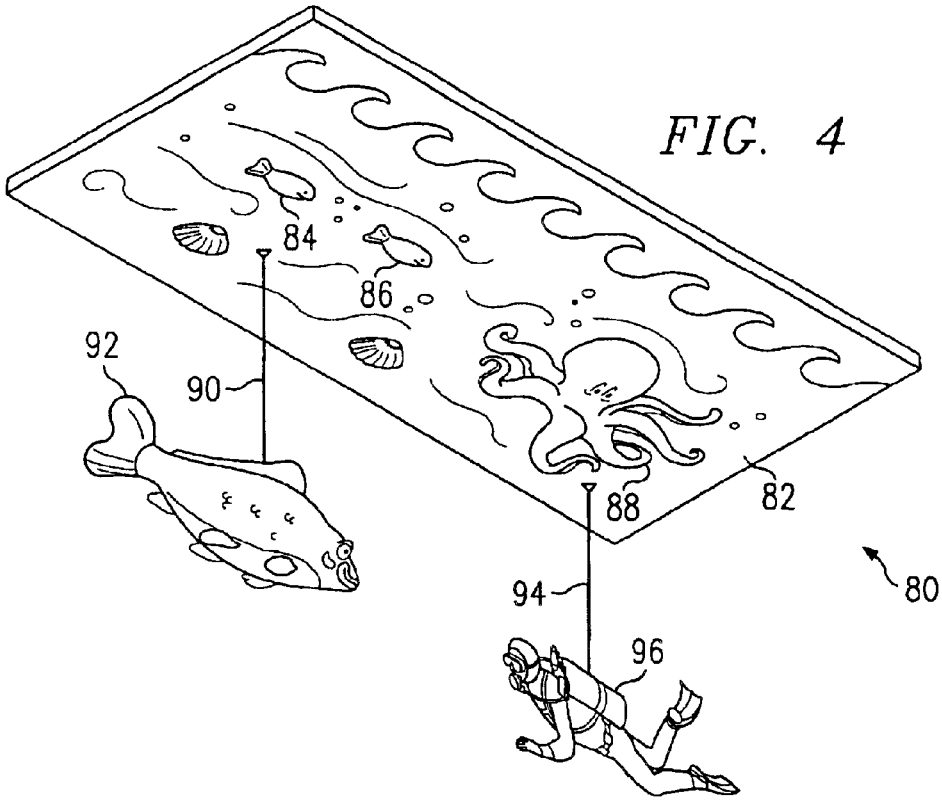
FIG. 4 is a perspective view of another embodiment of a visual stimulation attachment according to the present invention.

Referring to FIG. 4, a perspective view of another embodiment of a visual stimulation attachment 80 is presented. The background member 82 is shown with a sea-life theme and includes decorative attachments of fish 84 and 86 and an octopus 88. A first tether line 90 supports a dangling member 92 in the form of a fish, and a second tether line 94 supports a three-dimensional stuffed doll 96 in the form of a scuba diver. The dangling members 92 and 96 can be substantially two-dimensional items (e.g., fish 92) or three-dimensional items (e.g. doll 96).

Numerous other embodiments of the visual stimulation attachment are possible. In another embodiment of the invention, the background material can be a photograph or photographs or alternatively the decorative attachments or dangling members could be photographs or photograph frames. In another embodiment, the background member can be a lightweight flat visual screen that provides moving images (video or computer output) for the infant to view. A soft material to make it safe in the event of an accident preferably would surround the screen. Similarly dangling members might include lights or small flat screens (in that case tether might include wires). The attachment device might also include speakers providing entertaining sound or contain lights among other variations; a short sound recording might be especially useful to distract infants while the infant is being loaded into the car seat. Sound playback device could be added to virtually any embodiment. In different embodiments, the attachment might be used for other applications such as holding a memo pad or photo frame or other items on the ceiling for an adult in the vehicle, but it is primarily intended for use with a child infant seat or child. In the latter situation for a picture frame, it would be the same type of set up using a micro-hook material on the back (i.e. attachment device) of a piece of material to which a photo or other item is attached.

In one possible embodiment, the decorative attachments are attached to the background member with a hook-and-loop connection to allow for easy moving of the decorative items on the background. In this way, the scene can be readily changed to provide more variety for the infant or child. In addition, this approach might allow different decorative attachments to be added to the theme at later times; for example, the attachments could be given out with entertainment meals as a promotional campaign for a fast-food establishment. In a related embodiment, the decorative attachments might be game pieces that can moved on the background or directly on the headliner; for example, the background could include a tic-tac-toe grid and the decorative attachments could be Xs and Os.

Although the present invention and its advantages have been described in detail, it should be understood that various changes, substitutions and alterations can be made therein without departing from the spirit and scope of invention as defined by the appended claims. The term "about" as used in the claims is intended to imply a relatively broad interpretation of any range that it modifies; it is intended to be a flexible word with a meaning similar to "approximately" or "nearly.

I claim:

1. A visual stimulation attachment for amusing an infant riding in a child safety seat or a child in a vehicle, which has an interior ceiling with a headliner, the visual stimulation attachment comprising:

a background member having a first side and a second side; and an attachment device secured to the second side of the background member and the attachment device is operable to releasably couple the background member to a headliner.

* * * * *